United States Patent [19]

Nagai et al.

[11] Patent Number: 4,993,476

[45] Date of Patent: Feb. 19, 1991

[54] SECONDARY COOLING DEVICE FOR A HORIZONTAL CONTINUOUS CASTING APPARATUS

[75] Inventors: Yoshitaka Nagai, Asahi; Makoto Arase; Norio Ohatake, both of Toyama, all of Japan

[73] Assignee: Yoshida Kogyo K.K., Tokyo, Japan

[21] Appl. No.: 492,883

[22] Filed: Mar. 9, 1990

[30] Foreign Application Priority Data

Mar. 17, 1989 [JP] Japan ..... 1-29710[U]

[51] Int. Cl.[5] ..... B22D 11/124

[52] U.S. Cl. ..... 164/440; 164/444

[58] Field of Search ..... 164/440, 444, 490, 486

[56] References Cited

U.S. PATENT DOCUMENTS

| | | | |
|---|---|---|---|
| 2,578,213 | 12/1951 | Weldlund | 164/444 |
| 4,256,165 | 3/1981 | Von Starck et al. | 164/504 |
| 4,834,168 | 5/1989 | Nove et al. | 164/504 |

*Primary Examiner*—Kuang Y. Lin

*Attorney, Agent, or Firm*—Flynn, Thiel, Boutell & Tanis

[57] ABSTRACT

A secondary cooling device for a horizontal continuous casting apparatus, comprising (1) a support rod horizontally disposed before a tundish and above a cooling mold, (2) a holder slidably mounted on the support rod and incorporating a worm and a pair of worm gears engageable with each other, (3) an arm extending downwardly from the end of each of the worm gears, (4) half-annular shaped cooling water pipes secured onto the lower ends of the respective arms, said half-annular shaped cooling water pipes being so designed as to form an annular shape when brought together, (5) half-annular shaped wipers secured to the respective cooling water pipes on the side facing the tundish, the wipers being positioned concentrically with respect to said resulting ingot and having a inner diameter smaller than the diameter of the resulting ingot and (6) cooling water nozzles secured to the cooling water pipes on the side away from the tundish. Utilizing the thus constructed cooling device, casting operations are facilitated.

1 Claim, 3 Drawing Sheets

SECONDARY COOLING DEVICE FOR A HORIZONTAL CONTINUOUS CASTING APPARATUS

BACKGROUND OF THE INVENTION

1. Field of the Invention

The present invention relates to improvements in a secondary cooling device for a horizontal continuous casting apparatus.

2. Description of the Prior Art

It has been known that, in horizontal continuous casting procedures, ingots are subjected to primary water cooling, air cooling and secondary water cooling, in order to stably carry out the casting procedures.

An example of the conventional ingot casting procedures is described with reference to the accompanying drawings. In FIG. 4, reference numerals 1, 2 and 3 indicate a tundish, an orifice plate and a cooling mold, respectively. Melt 4 flows into the cooling mold 3 through the orifice plate 2 and is cooled by cooling water which is introduced into a cooling water inlet port 5, passed through a cooling water passageway 6 and, then, discharged from a cooling water nozzle 7. In such manner, an ingot 8 is formed. Cooling water adsorbed on the surface of the ingot 8 is removed by a wiper 10 attached onto the end of a support 9 which is secured to the cooling mold 3. Subsequently, the ingot 8 is passed through an air cooling zone and is subjected to secondary cooling using a secondary cooling nozzle 11. The secondary cooling nozzle 11 is a split type, as shown in FIG. 5, and is so designed that it is movable back and forth on both sides of the ingot 8 through a bracket 12*a* secured onto a heat insulating wall 12.

In the aforementioned conventional continuous casting apparatus, the wiper 10 is premounted. Therefore, when a problem arises, replacement of the wiper 10 requires troublesome operations. Further, since the half parts of the secondary cooling nozzle 11 are disposed individually on the opposite sides of the ingot 8, it is difficult to locate the secondary cooling nozzle 11 concentrically with the ingot 8 and cooling tends to be nonuniform. Further, when sliding of the secondary cooling nozzle 11 is required, the sliding operation should be effected on both sides of the ingot 8. Therefore, two workers are needed at the same time or, when the sliding is effected by one worker, the worker firstly carries it out on one side of the ingot 8 and then goes to the other side. Therefore, the sliding operation is not only laborious but also very dangerous.

SUMMARY OF THE INVENTION

It is, therefore, an object of the present invention to eliminate the aforementioned problems.

According to the present invention, there is provided a secondary cooling device for a horizontal continuous casting apparatus, comprising (1) a support rod horizontally disposed before a tundish and above a cooling mold,
(2) a holder slidably mounted on the support rod and incorporating a worm and a pair of worm gears so designed as to engage with each other,
(3) an arm extending downwardly from the end of each of the worm gears,
(4) half-annular shaped cooling water pipes secured onto the lower ends of the respective arms, the half-annular shaped cooling water pipes being so designed as to form an annuler shape when brought together,
(5) half-annular shaped wipers secured to the respective cooling water pipes on the side facing the tundish, the wipers being positioned concentrically with respect to the resulting ingot and having a inner diameter smaller than the diameter of the resulting ingot, and
(6) cooling water nozzles secured to the cooling water pipes on the side away from the tundish.

In such a specially arranged structure, the holder is slid along the support rod and fixed at a proper position. Then, the worm is rotated by a handle or a driving motor and the worm gears are actuated following the rotation of the worm. By the actuation of the worm gears, each cooling water pipe is closed or opened and the wiper is brought into contact with or is separated from the surface of the ingot.

DETAILED DESCRIPTION OF THE PREFERRED EMBODIMENT

A preferred embodiment of the present invention will now be described with reference to the drawings.

Figure 1:
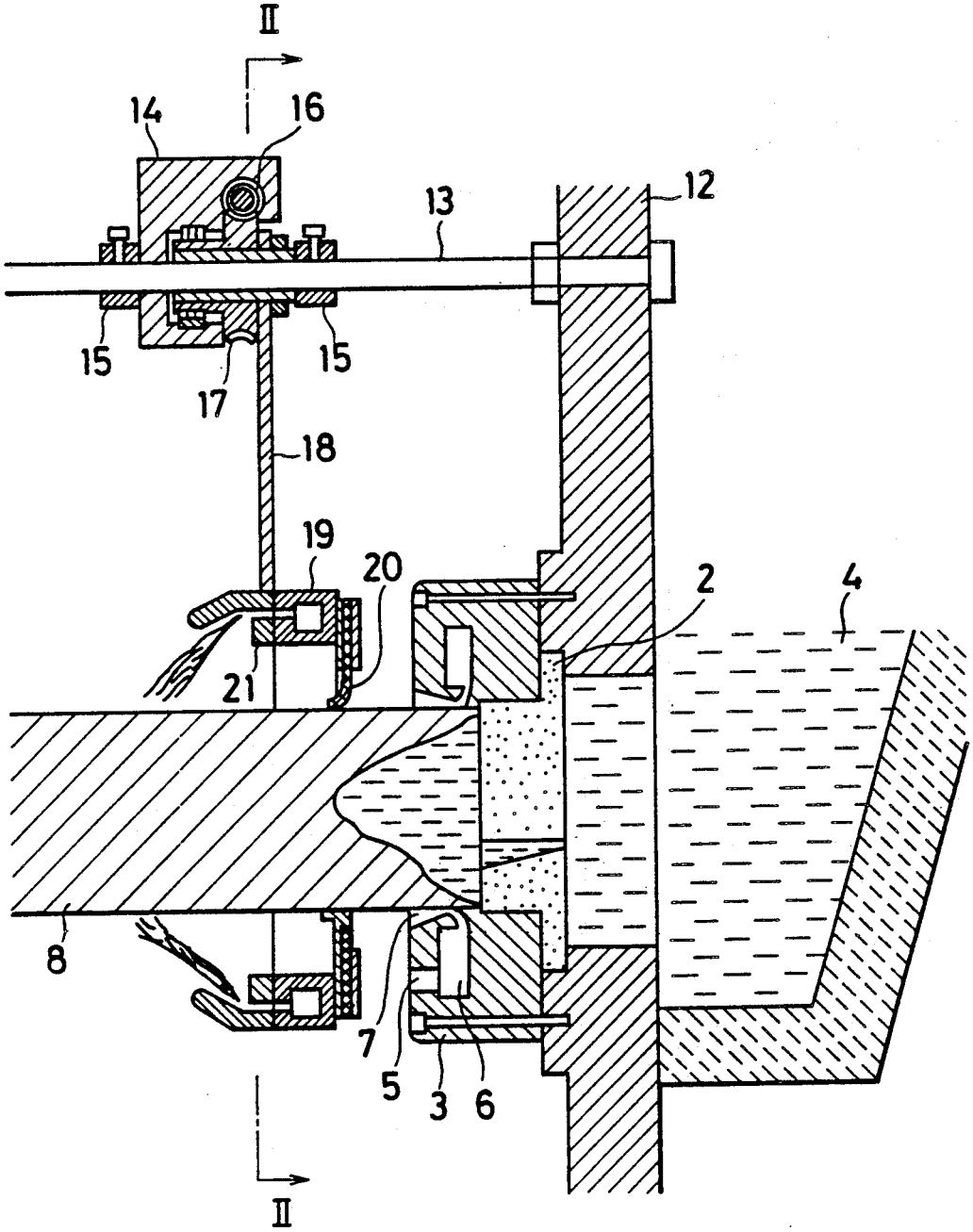
FIG. 1 is a sectional view illustrating an embodiment of the present invention.
Figure 2:
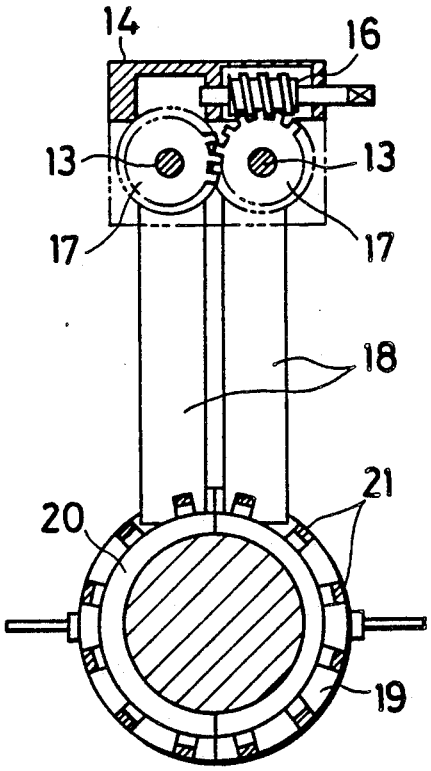
FIG. 2 is a cross section taken on line II—II of FIG. 1 showing the important parts.
Figure 3:
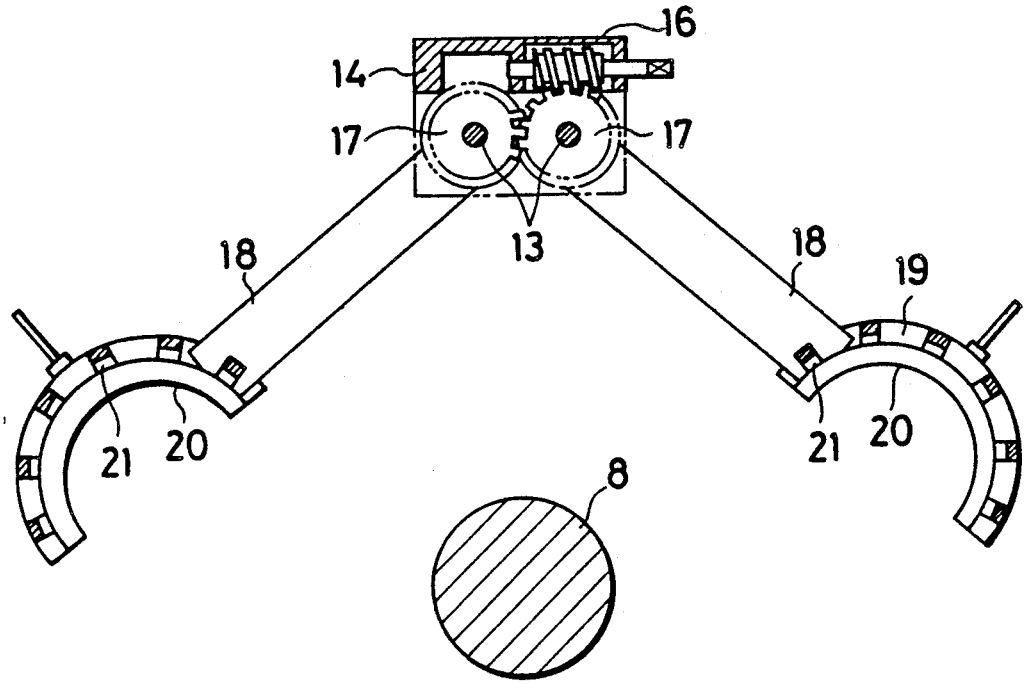
FIG. 3 is a front elevation illustrating arms in an opened state.
Figure 4:
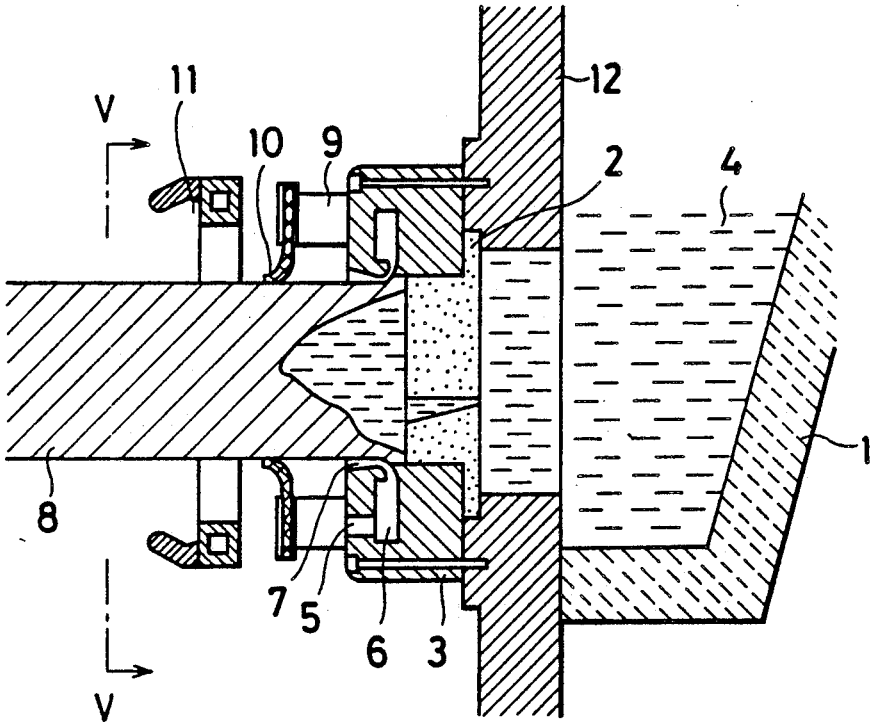
FIG. 4 PRIOR ART
FIG. 4 is a sectional view of a conventional embodiment.
Figure 5:
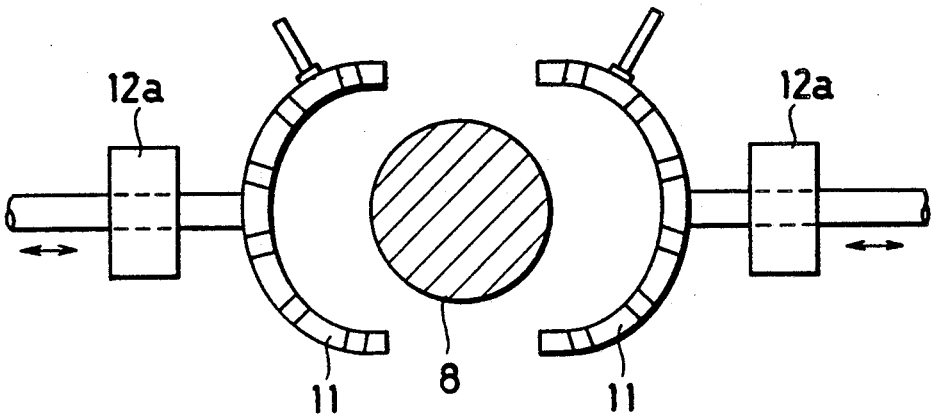
FIG. 5 PRIOR ART
FIG. 5 is a cross section taken on line V—V of FIG. 4 showing the important parts.

FIG. 1 shows the preferred embodiment and the same parts as the prior art embodiment as shown in FIGS. 4 and 5 are indicated by the same names and the same reference numbers. Reference numerals 13 indicate support rods fixed onto a heat insulating wall 12 and slidably supporting a holder 14. The holder 14 can be fixed at a desired position by means of fastening collars 15. As shown in FIGS. 2 and 3, a worm 16 is so connected to the holder 14 that it can be rotated by a handle or a driving motor and the worm 16 is engaged directly or indirectly with worm gears 17, 17 which are mounted on the support rods 13. An arm 18 extends downwardly from the lower end of each worm gear 17 and a cooling water pipe 19 is arranged at the lower end of each arm 18. On the side facing the tundish, the cooling water pipe 19 has a wiper 20, and, on the other side away from the tundish 1, it has a secondary cooling water nozzle 21. The wiper 20 is disposed concentrically with the resulting ingot 8 and is formed in a half-annular shape. The inner diameter of the wiper 20 is made smaller than the diameter of the ingot 8 so that the inner periphery of the wiper 20 frictionally contacts with the surface of the ingot 8. The secondary cooling water nozzle 21 is composed of a plurality of nozzles arranged with a predetermined spacing or a single slit. An additional holder may be disposed to arrange a tertiary cooling water nozzle.

According to the present invention, since the split type wiper and secondary cooling nozzle can be simultaneously opened or closed by actuation of the same handle or driving motor, the operation is significantly facilitated and the centering operation with respect to ingots becomes easy. Even if displacement of the secondary cooling device is required due to variations in the diameter or material of ingots, such displacement operations can be readily effected against such situations, because the holder is slidably mounted. Moreover, since the wiper is disposed apart from the cooling mold, it can be easily replaced.

What is claimed is:

1. A secondary cooling device in a horizontal continuous casting apparatus, comprising (1) support rod horizontally disposed before a tundish and above a cooling mold, (2) a holder slidably mounted on said support rod means and incorporating a worm and a pair of worm gears so designed as to engage with each other, (3) an arm extending downwardly from the end of each of said worm gears, (4) half-annular shaped cooling water pipes secured onto the lower ends of said respective arms, said half-annular shaped cooling water pipes being so designed as to form an annular shape when brought together, (5) half-annular shaped wipers secured to said respective cooling water pipes on the side facing said tundish, said wipers being positioned concentrically with respect to the resulting ingot and having a inner diameter smaller than the diameter of said resulting ingot, and (6) cooling water nozzles secured to said cooling water pipes on the side away from said tundish.

* * * * *